US008904810B2

(12) United States Patent
Schabron et al.

(10) Patent No.: US 8,904,810 B2
(45) Date of Patent: Dec. 9, 2014

(54) TEMPERATURE CONTROL TRANSPORT SYSTEM

(75) Inventors: John F. Schabron, Laramie, WY (US); Susan S. Sorini-Wong, Laramie, WY (US); Greg Wong, legal representative, Laramie, WY (US)

(73) Assignee: University of Wyoming Research Corporation, Laramie, WY (US)

( * ) Notice: Subject to any disclaimer, the term of this patent is extended or adjusted under 35 U.S.C. 154(b) by 1065 days.

(21) Appl. No.: 12/561,059

(22) Filed: Sep. 16, 2009

(65) Prior Publication Data

US 2010/0064698 A1 Mar. 18, 2010

Related U.S. Application Data

(60) Provisional application No. 61/097,436, filed on Sep. 16, 2008.

(51) Int. Cl.
*B65B 63/08* (2006.01)
*F25D 3/08* (2006.01)

(52) U.S. Cl.
CPC ..... *F25D 3/08* (2013.01); *F25D 2303/0843* (2013.01); *F25D 2303/0844* (2013.01); *F25D 2331/804* (2013.01)
USPC ..... 62/60; 62/371; 62/457.2

(58) Field of Classification Search
USPC ..... 62/60, 371, 372, 457.1, 457.2, 457.9
See application file for complete search history.

(56) References Cited

U.S. PATENT DOCUMENTS

| | | | | |
|---|---|---|---|---|
| 4,088,183 | A | 5/1978 | Anzai et al. | |
| 4,702,853 | A | 10/1987 | Benson et al. | |
| 5,976,400 | A * | 11/1999 | Muffett et al. | 252/70 |
| 6,209,343 | B1 * | 4/2001 | Owen | 62/457.2 |
| 6,332,334 | B1 * | 12/2001 | Faryabi | 62/371 |
| 7,257,963 | B2 | 8/2007 | Mayer | |
| 7,260,956 | B1 | 8/2007 | Schabron et al. | |
| 7,294,374 | B2 | 11/2007 | Romero | |
| 7,328,583 | B2 | 2/2008 | Hillman et al. | |
| 7,422,143 | B2 | 9/2008 | Mayer | |
| 7,500,593 | B2 | 3/2009 | Mayer | |
| 7,516,600 | B1 | 4/2009 | Flora | |
| 2005/0188714 | A1 * | 9/2005 | Wallace | 62/371 |
| 2006/0225863 | A1 | 10/2006 | Levin | |
| 2007/0180847 | A1 | 8/2007 | Schabron et al. | |
| 2007/0186577 | A1 * | 8/2007 | Goncharko | 62/371 |
| 2008/0099492 | A1 | 5/2008 | Mayer | |
| 2009/0145092 | A1 | 6/2009 | Flora | |

OTHER PUBLICATIONS

Credo Thermal Packaging Solutions, Minnesota Thermal Science, http://www.credothermal.com/AboutMTS/About_GoldernHour.aspx, printed Sep. 2, 2009.

(Continued)

*Primary Examiner* — Cassey D Bauer
(74) *Attorney, Agent, or Firm* — Santangelo Law Offices, P.C.

(57) ABSTRACT

Embodiments of the inventive technology may involve the use of layered, insulated PCM assemblage that itself comprises: modular insulating foam material 8 that, upon establishment as part of the assemblage, defines inner foam material sides 9 and outer foam material sides 10; thin reflective material 11 established against (whether directly in contact with or not) at least either the inner foam material sides or the outer foam materials sides, and modular, enclosed PCM sections 12 established between the modular insulating foam material and the interior center.

37 Claims, 2 Drawing Sheets

(56) References Cited

OTHER PUBLICATIONS

Figure 2:
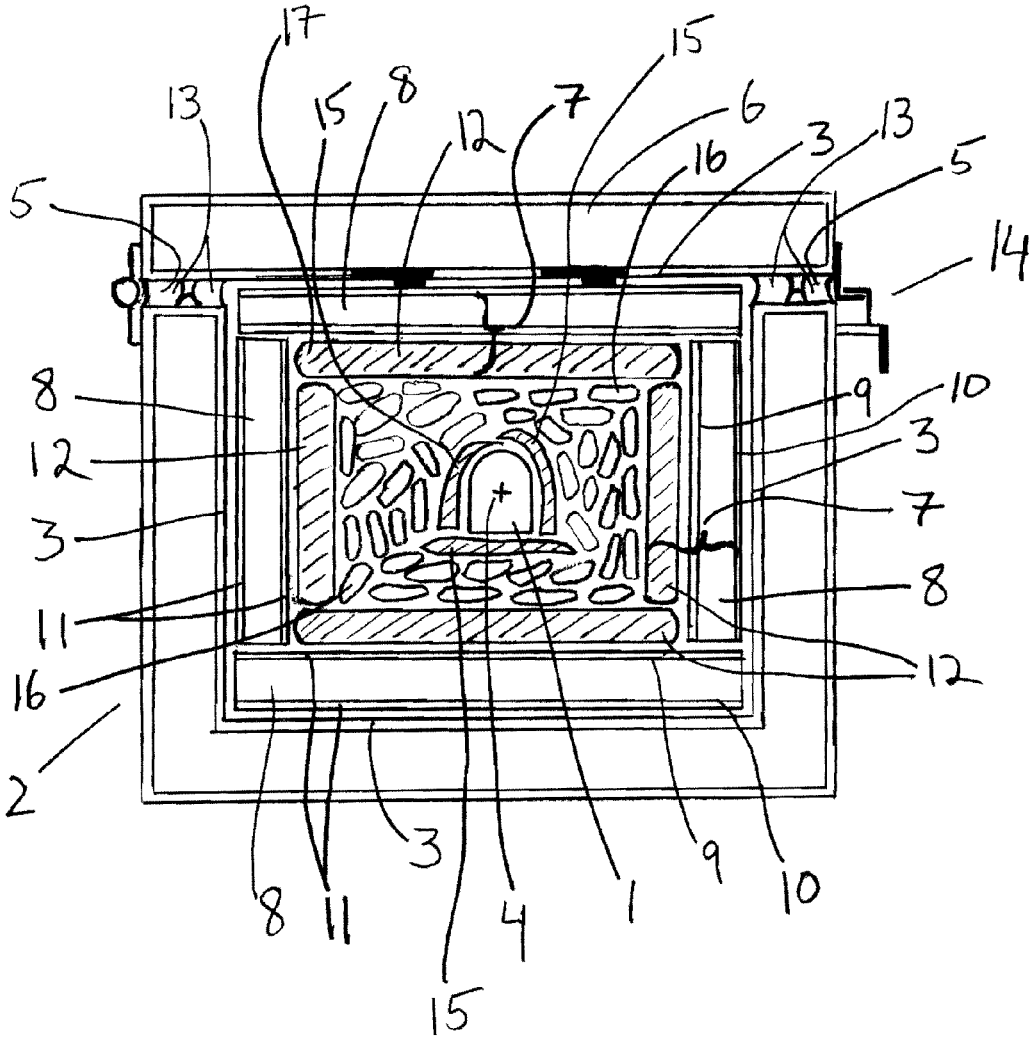

Modular Cold-Chain Shppers, Pharmaceutical & Medical Packaging New, P<P News Web Exclusive Apr. 2009, http://www.devicelinkg.com/grabber.php3~URL=http://www.devicelink.com/pmpn/archive..., printed Jun. 24, 2009.
Credo Cube, Minnesota Thermal Science, http://www.credothermal.com, printed Jun. 24, 2009.
Solution Finder, Minnesota Thermal Science, http://credothermal.com/SolutionFinder/SolutionFinder_Index.aspx, printed Sep. 16, 2009.
U.S. Appl. No. 60/583,177, Soroni-Wong, et al.
Blood Box: Battlefield Life Saver, Kevin Diaz, Star Tribune Washington Bureau Correspondent, Minneapolis Star Tribune, Jun. 16, 2005.
New Generation in Thermal Packaging Solutions Introduced, Minnesota Thermal Science Launches Credo Brand Products and Services, Minnesota Thermal Science, LLC, Paul Broz.
Minnesota Thermal Science Announces Revolutionary Cold Chain Solution, Minnesota Thermal Science Launches Credo Brand Products and Services, Minnesota Thermal Science, LLC, Paul Broz.
Integrated Freezer System, Topical and Final Report, Susan S. Sorinin, John F. Schabron, Western Research Institute, Jun. 2008.
Sorini, S.S. and J.F. Schabron, 2006, Phase Change Liquids. Laramie, WY, WRI Report WRI-06-R007. WRI Report to DOE under Cooperative Agreement DE-FC26-98FT40323.
U.S. EPA, 2002, Method 5035A: Closed-System Purge-and-Trap and Extraction for Volatile Organics in Soil and Waste Samples. Test Methods for Evaluating Solid Waste: Physical/Chemical Methods (SW-846), Draft Revision 1.
ASTM International, 2007b, ASTM Practice D 6418-04, Standard Practice for Using the Disposable En Core Sampler for Sampling and Storing Soil for Volatile Organic Analysis. Annual Book of ASTM Standards, 11.04, 583-596.
ASTM International, 2007a, ASTM Guide D 4547-06, Standard Guide for Sampling Waste and Soils for Volatile Organic Compounds. Annual Book of ASTM Standards, 11.04, 35-46.
Bolz, R.E. and Tuve, G.L., 1980, Handbook of Tables for Applied Engineering Science, 2nd Edition, CRC Press, Inc., Boca Raton, FL, Table 5-6.

* cited by examiner

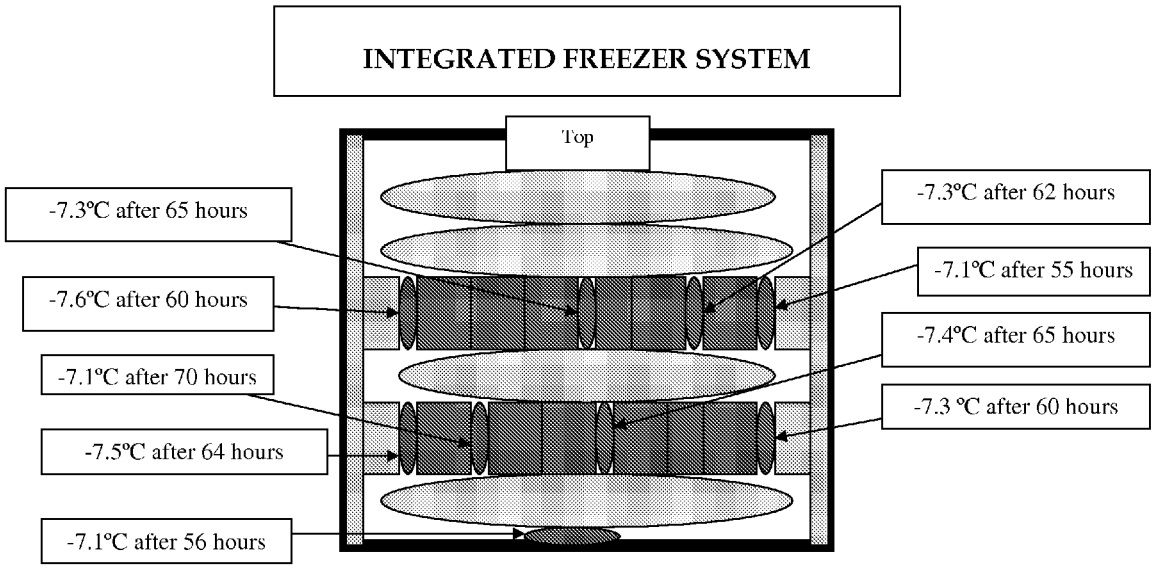

Double Thickness Foil-Foam-Foil Insulation

Phase Change Material

5-Gram Refrigerated Soil Sample in Bubble Wrap

Temperature Data Logger

Bubble Wrap Filler, 14.5g

Cooler: 24-quart Igloo MaxCold™

PCL Bag: 1,160 g PCL in 10" x 6" bag
PCL Half Bag: 150 g PCL in 4" x 6" bag
PCL sheet: 200 g PCL in 10" x 6" bag Room Temperature where Cooler Stored for 76 hours: Minimum at 20.7ºC
Maximum at 31.1ºC
Mean at 23.6ºC Average Cooler Temperature after One Hour of Storage: -20ºC

Figure 1

TEMPERATURE CONTROL TRANSPORT SYSTEM

This non-provisional patent application claims the benefit of and priority to U.S. Provisional Patent Application 61/097,436, filed Sep. 16, 2008, said provisional application incorporated by reference herein, in its entirety.

STATEMENT REGARDING FEDERALLY SPONSORED RESEARCH OR DEVELOPMENT

Funding for this study was provided by the U.S. Department of Energy, National Energy Technology Laboratory, under Cooperative Agreement DE-FC26-98FT40322, Task 3.D. The US federal government may have certain rights to this invention.

DISCLAIMER

This report was prepared as an account of work sponsored by an agency of the United States Government. Neither the United States Government nor any agency thereof, nor any of their employees, makes any warranty, expressed or implied, or assumes any legal liability or responsibility for the accuracy, completeness, or usefulness of any information, apparatus, product, or process disclosed, or represents that its use would not infringe on privately owned rights. Reference herein to any specific commercial product, process, or service by trade name, trademark, manufacturer, or otherwise does not necessarily constitute or imply its endorsement, recommendation, or favoring by the United States Government or any agency thereof. The views and opinions of authors expressed herein do not necessarily state or reflect those of the United States Government or any agency thereof.

BACKGROUND OF THE INVENTION

Soil samples for volatile organic compound (VOC) analysis are usually shipped to the laboratory in coolers with ice packs at refrigerator temperatures near 4° C. Once they arrive at the laboratory, the samples are either kept in a refrigerator prior to analysis, or they are placed in a freezer for longer-term storage. Both The U.S. Environmental Protection Agency (EPA) and ASTM International (ASTM) recognize the benefit of freezing samples, and many discussions have taken place with these entities concerning the feasibility of freezing samples in the field and shipping them at freezer temperatures (<−7 to −20° C.) to the laboratory for analysis. Using freezing as a preservation technique, sample holding time can be extended from 48 hours to 14 days.

Two possible ways of shipping frozen samples are to use a small, power-operated freezer compartment or dry ice storage. However, use of a power-operated freezer in the field is not feasible in most cases (indeed, in preferred embodiments of the inventive technology, no cooling is provided by electrical power). Dry ice storage is also not a viable option since air shipment of packages containing dry ice is regulated, because dry ice sublimes to gaseous carbon dioxide, which can displace air in sealed aircraft. Even more important relative to sample storage is that dry ice has a temperature of −78° C., which is so cold that it will cause the seals of sample containers to be compromised, and VOCs will be lost from samples when they thaw. Certain embodiments of the inventive technology disclosed and claimed herein seek to alleviate one or more of such problems.

ASTM and EPA are prescribing freezing temperatures of approximately −12±5° C. for storage of soil samples containing VOCs during shipment to the laboratory for analysis (ASTM 2007a, 2007b, U.S. EPA 2002). Phase change materials (PCMs) have the property of storing or releasing heat energy at a specific temperature, which is the temperature of fusion. For example, water acts as a phase change material (PCM) at 0° C. Salt-water solutions melt at lower temperatures than water depending on the salt type and concentration. Sodium chloride (NaCl) solutions are used to achieve temperatures of fusion below 0° C. A water/urea phase change formulation that has a melting range of −11 to −15° C. has previously been described (Salyer 1997). Different PCM formulations can be used depending on the needs and constraints (e.g., required sample temperature range and length of shipping or storage time) of the application. For example, in those applications where only refrigerator temps (e.g., 34-40 degrees F.) are needed, perhaps a pure water PCM formulation is adequate; in others, saltwater may be used. PCM formulations may be, but certainly are not limited to, those described in U.S. Pat. No. 7,260,956, or U.S. Pat. No. 7,516,600, as but two examples, and those particularly described in this disclosure.

In addition to the temperature of fusion, the heat of fusion is an important parameter. The higher the heat of fusion, the greater the capacity for the material to store or release energy at the temperature of fusion. The heat of fusion of water is near 80 cal/g (Bolz and Tuve 1980). A PCM formulation to be used in a cooler for shipping frozen samples should have as high a heat of fusion as possible. Addition of chemicals to water can lower the freezing point, but can also decrease the heat of fusion. Therefore, an optimal PCM formulation has a temperature of fusion in the desired temperature range while having a heat of fusion as close to that of water as possible.

BRIEF SUMMARY OF THE INVENTION

Embodiments of the inventive technology may involve the use of layered, insulated PCM assemblage that itself comprises: modular insulating foam material 8 that, upon establishment as part of the assemblage, defines inner foam material sides 9 and outer foam material sides 10; thin reflective material 11 established against (whether directly in contact with or not) at least either the inner foam material sides or the outer foam materials sides, and modular, enclosed PCM sections 12 established between the modular insulating foam material and the interior center.

Work was performed to develop a new integrated freezer system that uses a frozen phase change material (PCM; PCL, or phase change liquid, is a type of unfrozen PCM) formulation to maintain freezer temperatures in coolers for shipping environmental samples to the laboratory, or for storage. In previous work, several PCM formulations with temperatures of fusion ranging from approximately −14 to −20° C. were prepared and evaluated. Both temperature of fusion and heat of fusion of the formulations were measured, and an optimal PCM formulation was selected. The PCM was frozen in plastic bags (to form modular PCM sections, such filled bags merely being an example of such sections) and tested for its temperature profile in a cooler using a digital temperature data logger. This testing showed that the PCM formulation can maintain freezer temperatures (<−7 to −20° C., or other "sub-freezing" ranges shown below) for an extended period, such as the time needed for shipping samples by overnight courier. Next, experiments were performed using various cooler types packed with soil samples as would be done in the field for sample shipment to a laboratory. Based on experimental results, a new PCM formulation was selected. These experiments showed the importance of the type of cooler used in the system and that an insulating material within the cooler improves the performance of the freezer system. In this initial testing, an integrated freezer system containing soil samples and bags of the new frozen PCM formulation was shown to maintain temperatures at <−7 to −20° C., the range of frozen temperature storage recommended by EPA for environmental samples, for 47 hours.

Initially, various PCM formulations were prepared and measured for their temperatures and heats of fusion using differential scanning calorimetry (DSC). Based on the data from the DSC measurements, a PCM formulation to be used to prepare freezer bags for a cooler experiment was selected. This PCM formulation was 17 wt. % NaCl, 3 wt. % potassium chloride (KCl), 3 wt. % 7HF (a cellulose polymer added to give thickness to the formulation), and 77 wt. % deionized, distilled water. Freezer bags containing the PCM solution were prepared, and a cooler experiment to test the performance of the bags to maintain freezer temperatures in the cooler was performed. Results of this experiment showed that the PCM formulation can maintain freezer temperatures (<−7° C. to −20° C.) for an extended period, such as the time needed for shipping samples by overnight courier.

Next, a number of experiments were performed that provided significant information for use in developing an integrated freezer system. Experiments were performed using various cooler types packed with soil samples as would be done in the field for sample shipment to a laboratory. Based on the results of these experiments, a new PCM formulation of 17 wt. % NaCl and 83 wt. % deionized, distilled water was selected and used in additional experiments (Sorini and Schabron 2006). Experimental results showed the importance of the type of cooler used in the system and that an insulating material within the cooler improves the performance of the freezer system. In this testing, an integrated freezer system containing soil samples packed with bags of the new frozen PCM formulation was shown to maintain temperatures at <−7 to −20° C., the range of frozen temperature storage recommended by EPA for environmental samples, for 47 hours. A series of experiments was performed to optimize various features of the integrated freezer system, such as PCM bag size, bag/sample arrangement in the system, and cooler insulation.

Various PCM formulations were prepared and measured for their temperatures and heats of melting using differential scanning calorimetry (DSC). Based on the data from the DSC measurements, a PCM formulation to be used to prepare freezer bags for a cooler experiment was selected. Freezer bags containing the PCM solution were prepared, and a cooler experiment to test the performance of the bags to maintain freezer temperatures in the cooler was performed. Results of this experiment showed that the PCM formulation can maintain freezer temperatures (between −7° C. to −20° C.) for an extended period, such as the time needed for shipping samples by overnight courier.

Next, experiments were performed using various cooler types packed with soil samples as would be done in the field for sample shipment to a laboratory. Based on experimental results, a new PCM formulation was selected. The experiments showed the importance of the type of cooler used in the system and that an insulating material within the cooler improves the performance of the freezer system. In this initial testing, an integrated freezer system containing soil samples and bags of the new frozen PCM formulation was shown to maintain temperatures from −7 to −20° C., the range of frozen temperature storage recommended by EPA for environmental samples, for 47 hours. These results were very promising. Of course, the inventive technology is not limited to such temperature ranges, as, indeed, particular embodiments of the inventive system may maintain "sub-freezing" temperatures of <−9 to −22° C., <−11 to −24° C., and/or <−13 to −26° C., as but a few examples. Other temperature ranges include but are not limited to 7 to −7° C., 0 to −10° C., −1 to −10° C., 4 to 1° C., as but a few examples.

Experiments were performed to optimize various features of the integrated freezer system, such as PCM bag size, bag/sample arrangement in the system, and cooler insulation. The current integrated freezer system design, in particular embodiments, may include a double layer of foil-foam-foil insulation along the walls, top, and bottom of a 24-quart Igloo MaxCold™ cooler. Thin sheets of frozen PCM line the walls of the cooler. To simulate sample packing in the cooler, there are two rows of five-gram soil samples in 40-mL volatile organic analysis (VOA) vials wrapped in six-inch square sheets of bubble wrap. Each row contains six samples. At the ends of each sample row, there is a half bag of frozen PCM. A larger bag of frozen PCM is positioned at the bottom of the cooler and in between the two rows of samples, with two of these larger bags of frozen PCM placed on top of the top row of samples. Bubble wrap is used to fill the space at the top of the cooler. Temperature data from these experiments show that the average cooler temperature after one hour of storage was approximately −20° C. and that temperatures ranged from −7.6° C. to −7.1° C. after 55 to 70 hours of storage depending on the location of the temperature data logger in the cooler.

As should be understood, the inventive technology, in various embodiments, may focus on the establishment PCM formulation against the walls (e.g., four side walls, and top and bottom) of a cooler and/or the use of an enhanced insulation cooler where, e.g., the walls of a cooler (a type of container) may be provided with additional insulation (perhaps in the form of insulation inserts, as but one example). Enclosed PCM may also be added, perhaps in the form of panels (e.g., frozen bags of PCM, plastic encased PCM). Additionally, bubble wrap, or, instead, formed inserts of protective material such as egg carton cardboard, plastic, or foam materials, for example, could be used to hold the sample containers and/or fill unoccupied space. Advantages afforded by the technology include but are not necessarily limited to improvement(s) in the ability of coolers to maintain sufficiently low temperatures for various sample shipping and/or storage application. Of course, other advantages may be disclosed in the remainder of the application.

BRIEF DESCRIPTION OF THE TABLES AND FIGURES

Tables

1. Temperature Data Recorded by the Four Temperature Data Loggers in the Cooler having Single Layer Insulation
2. Temperature Data Recorded by the Four Temperature Data Loggers in the Cooler having Double Layer Insulation
3. Temperature Data Recorded by the Ten Temperature Data Loggers in the Cooler having Double Layer Insulation and Thin Sheets of Frozen PCM Lining the Cooler Walls
4. Temperature Data Recorded by the Ten Temperature Data Loggers in the Cooler having Double Layer Insulation, Thin Sheets of Frozen PCM Lining the Cooler Walls, and PCM Half Bags
5. Temperature Data Recorded by the Nine Temperature Data Loggers in the Cooler having Double Layer Insulation, Thin Sheets of Frozen PCM Lining the Cooler Walls, PCM Half Bags, and Sample Vials in Bubble Wrap

FIGURES

1. FIG. 1 shows a cross-sectional view of an embodiment of the inventive system.

2. FIG. 2 shows a cross-sectional view of an embodiment of the inventive system.

DETAILED DESCRIPTION OF INVENTION

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Embodiments of the inventive technology may be described as an improved method for maintaining temperature sensitive material 1 at sub-ambient temperatures (e.g., below temperatures outside of a container, during shipping of the container) and may comprise the steps of: obtaining a closeable container 2 that is designed to maintain temperature sensitive material enclosed therein at sub-ambient temperatures, wherein the closeable container, when closed, has an inner container surface 3, defines an interior center 4, and forms a airtight vapor barrier 5, the method further including the steps of assuring the closeable container has a flexible gasket, airtight lid 6; and establishing a layered, insulated PCM assemblage 7 inside of the inner container surface and to fully surround the temperature sensitive material. It is of note that a container may be obtained via purchase (as of a commercially available container) or manufacture, and that certain embodiments focus on improving the insulation capabilities of a commercially available cooler.

The layered, insulated PCM assemblage may itself comprise: modular insulating foam material 8 (including, but not limited to, Styrofoam panels) that, upon establishment as part of the assemblage, defines inner foam material sides 9 and outer foam material sides 10; thin reflective material 11 (e.g., metal foil, Mylar) established against (whether directly in contact with or not) at least either the inner foam material sides or the outer foam materials sides, and modular, enclosed PCM sections 12 (e.g., plastic encased PCM, whether panels with straight sides or otherwise) established between the modular insulating foam material and the interior center, wherein the layered, insulated PCM assemblage is established such that the modular insulating foam material is established proximally the inner container surface (whether in direct contact therewith or not). The reflective service e.g., foil—which may form a radiant barrier—may be thin, such as thinner than the thickness of the foam, such as, but not limited to, 5.3 or 2 mils, or 0.25 mm, 0.1 ml, etc., or ranges defined by one or more of such thicknesses. It is of note that modular, in preferred embodiments, indicates the referenced "thing" or "things" is in sections or parts so that they may be assembled piece-by-piece into their final position (during, e.g., shipping).

It is of note that, as used herein, between is defined such that if A is between X and Y, there may or may not be another layer (e.g., B) that is established between X and A and/or Y and A. Further, the step of establishing a layered, insulated PCM assemblage inside of the inner container surface and to fully surround temperature sensitive materials may comprise the step of closing the flexible gasket, airtight lid. It is of note that the term flexible gasket (e.g., elastomeric gasket), airtight lid merely implies a lid (whether on the top of the container or otherwise) which, when physically pressurized (e.g., from above and below), as would occur when a lid of certain commercially available coolers is latched closed, creates an airtight seal. Even where the gasket 13 is entirely or primarily attached not to the lid but to the remainder of the container, the lid is considered a flexible gasket, airtight lid. Indeed, if a lid, when pressuredly closed, creates an airtight seal through use of a flexible gasket, the lid is a flexible gasket, airtight lid. It is of note that embodiments of the inventive technology are not limited to those with flexible gasket, airtight lids, as airtight seals might possibly be created in other manners (perhaps an interference fit between two plastic, non-flexible parts can create an airtight seal if pressurized, as but one example). Certain broad embodiments may be described as including merely an airtight lid. If a purchased cooler does not have lid pressurizing device 14 (e.g. a latch that when turned, brings the lid even further downwards—perhaps only mms. so—toward the rest of the container), then, e.g., pressure can be applied manually to the lid and tape or straps, for example, can be used to keep the lid in such pressure configuration, thereby maintaining an airtight seal, or a lid pressurizing device can be retrofitted onto the cooler.

Temperature sensitive material 1 is any material whose suitability for an intended use or application, or otherwise, will be adversely affected by temperatures which are too high for that material (and perhaps for its application). It is of note that even where two or more distinct samples of the same type of material, or even one or more samples of materials of different types, are contained, then it can still be said that a material (singular) is being contained. Examples of such materials 1 include but are not limited to non-frozen food, frozen food, drink, flowers, plants, blood, serum, plasma, serum, pharmaceuticals, frozen hockey pucks, non-frozen environmental samples, frozen environmental samples, and medical materials (e.g., organs for transplant). Methods used to maintain the temperatures of environmental samples in particular may be described as sub-ambient environmental sample temperature control methods.

The term surface is not limited as including only one planar surface, as indeed the term surface can include a multi-planar surface (e.g., the six sided inner surface of a commercially available cooler can indeed be considered a single surface). The interior center would be the spatial center point defined by such surface (and the volume enclosed by such surface). The term air-tight, or air-tight vapor barrier implies that there is no vent that allows fluid within the container to escape. Indeed, in preferred embodiments, the container can experience pressure differentials (outside relative to inside, perhaps even 10%, 15%, or 20% different, or those differentials that may be experienced during shipping (e.g., on a cargo transport flight), as but a few examples), whether positive or negative, without allowing the passage of fluid from outside (or inside) of the container to inside (or outside) the container.

The step of assuring the closeable container has a flexible gasket, airtight lid can be accomplished by, e.g., either selectively purchasing a container (e.g., a cooler) with such a lid, adapting a purchased container to have such a lid, or manufacturing a container to have such a lid. The step of establishing a layered, insulated PCM assemblage inside of the inner container surface and to fully surround the temperature sensitive material can be accomplished in any of several manners, regardless of the order of the individual assembly steps (e.g., the reflective material can be positioned (established) before the foam is positioned), or foam positioned after the reflective material is positioned). Often, the assemblage will have an outer surface that will mimic (but be smaller than) the inner surface of the container (whether multi-planar "box" shaped (cubic, rectangular prism, square prism, or otherwise), or, e.g., even spherical)). In non-spherical designs, the inner container surface may include inner side wall surfaces, an inner upper lid surface, and an inner bottom floor surface.

It is of note that in certain embodiments, unoccupied space in the container (e.g., space, such as air space, which, after establishment of the layered, insulated PCM assemblage, is not occupied with either foam material, enclosed PCM, or reflective material, and which is also not occupied—or not to be occupied—by PCM packets 15), may be filled with non-PCM such as space-filler insulation 16 (e.g., bubble wrap, or foam). Such additional space filling foam—and such PCM packets, if used—are not considered part of the layered, insulated PCM assemblage. It is of note that where the method includes the step of adding PCM packets internally of the modular, enclosed PCM sections when established inside of the closeable container, such may be done in any order (and even incrementally, alternatingly) relative to the step of filling unoccupied space with space filler insulation (when such step is performed). For example, after the layered, insulated PCM assemblage is established in the container (before the lid is closed, of course), some space filler insulation may be established above the bottom of the layered, insulated PCM assemblage, then some PCM packets established thereabove, then the sample placed thereon, then the unoccupied sides around the sample filled (from the "outside in") with space-filler insulation and PCM packets, then the area above the sample filled (from the "inside out") with PCM packets and space filler insulation (the lid could then be closed and pressure latched so as to create an air-tight seal). Of course, this is only one of many ways in which unoccupied space can be occupied, thereby achieving the advantage of preventing or at least moderating convective fluid (e.g., air) currents in the closed container (such currents compromising insulation).

It is of note that the inner container surface may be of any of a variety of shapes (as mentioned above, cubic, rectangular prism, square prism, as but a few examples). Where it is cubic, rectangular prism or square prism, it typically will have 6 sides (6 planar sides). In such flat sided designs, there may be 6 PCM sections (one of which may be a lid-affiliated panel 17); however, there may be more, as panels may be sized such that more than one panel is need for a side(s), or fewer, as where one panel is usable for more than one side at one time. In certain spherical designs, there may be perhaps only two PCM sections (e.g., an upper lid-affiliated section, and a lower base section). It is of note that spherical container (perhaps with a flat bottom for stability) are deemed part of the inventive technology. One merely need change the container shapes and the foam and PCM section shapes of the Figures from rectangular to curved as appropriate to arrive at a spherical embodiment. In certain embodiments, the container may be cubic, or rectangular or square prism, while the PCM sections therein may have an outer surface that mimics such shape, and an inner surface that is different (perhaps it mimics the different outer surface shape of the temperature sensitive material, or is spherical).

Of course, the term lid-affiliated implies that the referenced term is, because of final position, the section which would most reasonably be considered as being associated (or affiliated) with the lid (which is the openable part of the container, regardless of whether it is positioned on the top or the side of the container). Such lid-affiliated PCM section can be either incorporated as part of the lid (e.g., perhaps it is slid into a lid that is adapted to receive such a PCM section in such a sliding manner), or not (it may just sit on side PCM panels, e.g.).

It is of note that in certain embodiments, thin reflective material that may be established against at least either the inner foam material sides or the outer foam material sides may be described as thin reflective material that is established against both the inner foam material sides and the outer foam material sides. Such might help to enhance the overall insulative effect. Further, the step of establishing a reflective surface against an inner or outer side of the insulating foam material can include the step of adding foam that already has reflective surface on it, or placing the reflective material thereon independently of (e.g., after) the foam is assembled as part of the assemblage. It is also of note that preferred embodiments may include the step of freezing PCM of the modular, enclosed PCM sections before the step of establishing a layered, insulated PCM assemblage inside of the inner container surface and to fully surround the temperature sensitive material. However, the inventive technology also contemplates placing non-frozen PCM into position internally of the container, and then freezing the container (and contents, whether such contents include the sample or not). Preferably, but not necessarily, the container is not pre-cooled. Regardless, preferred embodiments of the inventive technology do not involve the use of dry ice in any manner. Indeed, not using dry ice allows for the use of an airtight seal, which by itself enhances insulation. Use of non-venting containers allows for use of a commercially available closeable container with airtight lids (and with no vents in the lid or the rest of the container, whether such vents be slots or fluidic passageways through container side material (e.g., cardboard) or container features (e.g., overlapping flaps of the container side material)), and air shipment in any country (some countries prohibit dry ice shipping by air). This is in addition to the overall benefit of the surprisingly good, synergistic insulation and temperature maintenance resulting from the inventive combination of steps and system components, and, in particular embodiments, the benefit of flexibility that allows the customization, on-site (perhaps just before the time of shipment), upon proper selection of PCM formulation and paneling.

The method may involve the use of PCM of the modular, enclosed PCM sections that is specifically formulated for a time period and at least one of a maximum temperature or temperature range. Formulating (or selecting formulations) in such manner is well known (see, e.g, U.S. Pat. No. 7,260,956 and U.S. Pat. No. 7,516,600). Of course, in preferred embodiments, the PCM is in a solid state (frozen) when the container is closed. Temperatures above 0 degrees C. (refrigerator temperatures) may be used by selecting a PCM that freezes near (e.g., above 0 degrees C.), such as thickened water, or "blue ice" PCM. In certain embodiments (other than those that maintain refrigerator temperatures), the starting temperature of the frozen PCM may be as low as −30 degs C, e.g. (note that the starting temperature may be lower than the melting temperature of the PCM). Of course, maintaining something at or below a certain temperature does not mean doing so indefinitely. Typically, a certain duration (e.g., a shipping time) is known, and that establishes the minimum time needed to maintain the temperature of an enclosed temperature sensitive material.

1. First Cooler Experiment Using Single Layer Insulation

Four plastic bags, each containing 1,160 grams of PCM formulation (17 wt. % NaCl and 83 wt. % deionized, distilled water), were prepared. The bags were placed in a digitally controlled freezer and were kept in the freezer at a mean temperature of −28° C. for approximately five days to make sure they were completely frozen at the time the cooler experiment was started. The bags that were used to hold the PCM are ten-inch by six-inch, thick-walled Temtro™ premium bags.

The cooler used in the experiment was a 24-quart polyethylene Igloo MaxCold™ insulated cooler designed for food and beverage storage. The cooler is insulated and has an insulated lid. In previous experiments, 18-quart Igloo MaxCold coolers were used; however, the 18-quart coolers are no longer manufactured. The temperature data loggers that were used in the cooler to record the temperature profile are Testo® 174 mini portable battery-powered data loggers from Testo, Inc., Lander, N.J. These have a measuring range of −30 to +70° C. For this experiment, three temperature data loggers were programmed to record temperatures on an hourly basis. Two of the data loggers were placed in the cooler and one was placed in the room where the cooler was stored during the experiment.

The soil used in this experiment is 75% sand, 13% silt, 12% clay, 4.3% organic material, and ~12% moisture. Twelve five-gram samples of the soil were added to 40-mL volatile organic analysis (VOA) vials. The samples were placed in a refrigerator for storage at 4±2° C. for approximately six days to make sure they were at a temperature of 4±2° C. when the cooler experiment was started.

For the experiment, the bottom, top, and sides of the cooler were lined with a single layer of Prodex® foil-foam-foil insulation. To simulate sample packing in the cooler, there were two rows of the five-gram soil samples in 40-mL VOA vials. Each row contained six samples. One of the bags of frozen PCM was positioned at the bottom of the cooler and in between the two rows of samples, with two of these large bags of frozen PCM placed on top of the top row of samples. Bubble wrap was used to fill the space at the top of the cooler. The cooler was at room temperature when it was packed.

To simulate sample packing, the soil samples are at 4° C. and are wrapped in twelve-inch square sheets of bubble wrap when placed in the cooler for storage. After samples are collected in the field, they are immediately cooled to 4° C. to prevent VOC loss. For using the PCM formulation, samples would be collected in the field, placed in a cooler with ice packs during sample collection, and transferred to a cooler containing the frozen PCM bags for freezing during shipment to the laboratory. For shipping, the samples are wrapped in bubble wrap to prevent breakage. To evaluate the performance of the integrated freezer system, one temperature data logger was placed in the center of the top row of samples and the second temperature data logger was placed at the end of the top row of samples. As mentioned, a third temperature data logger was placed in the room where the cooler was stored during the experiment.

The three temperature data loggers were programmed for the first temperature recordings to begin one hour after the cooler was packed. The cooler was opened approximately 48 hours later after the $49^{th}$ temperature readings were recorded. It is of note that the description of this and all experiments herein are not in any manner intended to limit the scope of the inventive technology, even if such descriptions include critical language.

2. Second Cooler Experiment Using Single Layer Insulation

When the cooler from the first experiment using single layer insulation was opened, it was observed that the cooler lid did not seal flat against the entire perimeter of the cooler body. Two other Igloo MaxCold coolers were checked. The lids of these coolers appeared to seal better than the cooler used in the experiment. The cooler appearing to have the best seal between the lid and cooler body was selected and the cooler experiment using a single layer of insulation was repeated as described above.

3. Cooler Experiment Involving Single and Double Layer Insulation and Thin Sheets of Frozen PCM Lining the Cooler Walls A cooler experiment was performed involving two coolers. One cooler was lined with a single layer of the foil-foam-foil insulation, and one cooler was lined with a double layer of the foil-foam-foil insulation. Both coolers contained thin sheets of frozen PCM attached to the insulation.

Twenty-eight thin sheets of frozen PCM formulation were prepared by adding 200.0 grams of PCM to the ten-inch by six-inch Temtro thick-walled plastic bags. The bags were placed flat on cookie sheets and placed in the digitally controlled freezer at a mean temperature of −28° C. The PCM sheets containing 200 grams of formulation and four bags, each containing 1,160 grams of PCM, were kept in the freezer for approximately 18 days before the experiment was started.

Two of the 24-quart polyethylene Igloo MaxCold insulated coolers were used in this experiment. For the experiment, nine temperature data loggers were programmed to record temperatures on an hourly basis. Four of the temperature data loggers were placed in the single insulation cooler; four were placed in the double insulation cooler; and one was placed in the room where the coolers were stored during the experiment.

The soil used in this experiment was the soil containing 75% sand, 13% silt, 12% clay, 4.3% organic material, and ~12% moisture that was used in the previous experiments. Twenty-four five-gram samples of the soil in 40-mL VOA vials were prepared. The samples were placed in a refrigerator for storage at 4±2° C. for approximately six days to make sure they were at a temperature of 4±2° C. when the cooler experiment was started.

For the experiment, the bottom, top, and sides of one cooler were lined with a single layer of Prodex foil-foam-foil insulation. The bottom, top, and sides of the second cooler were lined with a double layer of Prodex foil-foam-foil insulation. Both coolers had thin sheets of frozen PCM lining the insulation attached to the walls of the cooler. Both coolers contained two rows of the five-gram soil samples wrapped in bubble wrap. Each row contained six samples. One of the large bags (1,160 grams) of frozen PCM was positioned at the bottom of the cooler and in between the two rows of samples, with two of these large bags of frozen PCM placed on top of the top row of samples. Bubble wrap was used to fill the space at the top of the coolers. The coolers were at room temperature when they were packed.

As discussed above, each cooler contained four temperature data loggers. One temperature data logger was placed at one end of the bottom row of samples; one was placed in the middle of the bottom row of samples; one was placed in the middle of the top row of samples; and one was placed at the opposite end of the top row of samples. As mentioned, a temperature data logger was also placed in the room where the coolers were stored during the experiment. The temperature data loggers were programmed to record temperatures on an hourly basis. The coolers were opened after approximately 50 hours of storage.

4. Cooler Experiment Involving Double Layer Insulation and Thin Sheets of Frozen PCM Lining the Cooler Walls with Ten Temperature Data Loggers in the Cooler In this experiment, one cooler was used. This cooler had the same design as the cooler having double insulation in the previous experiment, except ten temperature data loggers were positioned in the cooler to obtain additional information about the temperature at various locations within the cooler during storage: one at the bottom of the cooler, one at the top of the cooler, one at each end of each sample row, one in the middle of each sample row, and one in each sample row. A temperature data logger was also placed in the room where the cooler was stored during the experiment. The temperature data loggers were programmed to record temperatures on an hourly basis. The coolers were opened after approximately 51 hours of storage.

5. Cooler Experiment Involving Double Layer Insulation, Thin Sheets of Frozen PCM Lining the Cooler Walls, and PCM Half Bags The results of the experiment described above showed that the temperatures at the ends of the sample rows, along the cooler walls, were higher than the temperatures at the other locations where the temperature data loggers were positioned. To address this, four half bags of PCM containing 150 grams of formulation were prepared so they could be placed along the walls at each end of the two sample rows. The dimensions of each half bag are four inches by six inches by about three inches. The cooler used in this experiment had the same design as the cooler used in the previous experiment, except for the placement of the half bags at the ends of the sample rows and because there was not enough room in the cooler with the half bags, the bubble wrap around the sample VOA vials had to be removed for the experiment.

The large PCM bags, PCM sheets, and PCM half bags were in the freezer for approximately eight days before the experiment was started. Ten temperature data loggers were positioned in the cooler: one at the bottom of the cooler, one at each end of each sample row, one in the middle of each sample row, and two in each sample row. The temperatures in the cooler were recorded on an hourly basis. There was also a temperature data logger in the room where the cooler was stored during the experiment. The cooler was opened after approximately 72 hours of storage.

6. Cooler Experiment Involving Double Layer Insulation, Thin Sheets of Frozen PCM Lining the Cooler Walls, PCM Half Bags, and Sample Vials in Bubble Wrap Because samples shipped from the field to the laboratory must be protected from breakage during shipment, the samples shipped in the integrated freezer system must be wrapped in a protective material such as bubble wrap. As a result, the previous experiment was repeated with the twelve sample VOA vials each wrapped in six-inch by six-inch square sheets of bubble wrap. This gave enough space in the cooler for the half bags of PCM at the ends of the sample rows and nine temperature data loggers, as well as the larger PCM bags, double insulation, and PCM sheets. The nine temperature data loggers were placed at various locations in the cooler: one at the bottom of the cooler, one at each end of each sample row, one in the middle of each sample row, and one in each sample row. The cooler was opened after approximately 76 hours of storage.

RESULTS AND DISCUSSION

1. First Cooler Experiment Using Single Layer Insulation

The temperature in the room where the cooler was stored ranged from 22.7 to 25.3° C. over the 48-hour period, with a mean temperature of 24.5° C. Temperature data recorded by the data logger that was placed in the center of the top row of samples showed that after one hour of storage, the temperature was −17.1° C. After 42 hours of storage, the temperature at that location was −7.3° C., and after 43 hours of storage, the temperature was −6.8° C., which is above the EPA recommended temperature for frozen storage (<−7 to −20° C.).

Temperature data recorded by the data logger that was placed at the end of the top row of samples showed that after one hour of storage, the temperature was −6.0° C. After only seven hours of storage, the temperature at that location was −7.1° C., and after eight hours of storage, the temperature was −6.9° C., which is above the EPA recommended temperature for frozen storage.

The lid of the cooler used in this experiment was examined. It did not sit flat against the body of the empty cooler without applying pressure. It is believed that this problem, combined with using too much bubble wrap at the top of the cooler so that additional pressure was required for the lid to seal against the body of the cooler, resulted in the poor temperature data for this experiment.

The lids of two other 24-quart Igloo MaxCold coolers were examined for how well they seal. The lids of these coolers close easily and stay in contact with the bodies of the coolers with no pressure being applied. As a result, it was decided to repeat this experiment using one of the other coolers.

2. Second Cooler Experiment Using Single Layer Insulation

The temperature in the room where the cooler was stored ranged from 19.7 to 24.2° C. over the 48-hour period, with a mean temperature of 22.2° C. Temperature data recorded by the data logger that was placed in the center of the top row of samples showed that after one hour of storage, the temperature was −17.1° C. After 46 hours of storage, the temperature at that location was −7.3° C., and after 47 hours of storage, the temperature was −6.5° C., which is above the EPA recommended temperature for frozen storage (<−7 to −20° C.).

Temperature data recorded by the data logger that was placed at the end of the top row of samples showed that over the 48-hour period, a temperature of <−7° C. was not achieved. These data show that despite correcting the cooler sealing problem, modification to the cooler design was needed to improve the performance of the integrated freezer system, especially along the walls of the cooler.

3. Cooler Experiment Involving Single and Double Layer Insulation and Thin Sheets of Frozen PCM Lining the Cooler Walls To address the higher temperatures along the cooler walls during sample storage, a cooler experiment was performed involving two coolers. One cooler was lined with a single layer of foil-foam-foil insulation and one cooler was lined with a double layer of the foil-foam-foil insulation. Both coolers contained thin sheets of frozen PCM attached to the insulation to lower the temperatures along the cooler walls.

The coolers in this experiment were stored for 50 hours. The temperature in the room where the coolers were stored ranged from 22.5 to 25.3° C. over the 50-hour period, with a mean temperature of 23.7° C. Temperature data recorded by the four data loggers in the cooler having the single layer of insulation are listed in Table 1. Temperature data recorded by the four data loggers in the cooler having the double layer of insulation are listed in Table 2.

The temperature data listed in Tables 1 and 2 show that attaching the sheets of frozen PCM to the insulation caused the temperatures along the walls of the coolers to be significantly reduced for an extended period of time as compared with the data generated in the first and second experiments. The data in Tables 1 and 2 show similar performances for both coolers, with the exception of the data for the left end of the bottom sample row in the cooler having double layer insulation. Temperatures <−7° C. were maintained for a significantly longer period of time (46 hours) at this location (Table 2) than in the cooler having single layer insulation (31 hours shown in Table 1). It is of note that the contained PCM (whether as sheets of frozen PCM or otherwise) be can be placed loosely in the cooler, perhaps held in place by contents therewithin, or can be secured to the inner walls of the cooler. The PCM may be contained perhaps in bags, molded segments of the cooler or distinct therefrom, or hollow walls of the cooler (perhaps the cooler is adapted or configured especially to accommodate the inventive technology), as but a few examples. Indeed, in some applications, where melted PCM is either minimal or of little detrimental impact, the frozen PCM can be uncontained. Additional PCM can be placed within the cooler chamber alongside the samples.

4. Cooler Experiment Involving Double Layer Insulation and Thin Sheets of Frozen PCM Lining the Cooler Walls with Ten Temperature Data Loggers in the Cooler The next experiment that was performed had the same design as the cooler having double insulation in the previous experiment, except ten temperature data loggers were positioned in the cooler to obtain additional information about the temperatures at various locations within the cooler during storage.

The cooler in this experiment was stored for 51 hours. The temperature in the room where the cooler was stored ranged from 23.0 to 25.9° C. over the 51-hour period, with a mean temperature of 24.2° C. Temperature data recorded by the 10 data loggers in the cooler are listed in Table 3.

The data presented in Table 3 show that all of the locations where temperature data loggers were positioned in the cooler were at temperatures <−7° C. for over 48 hours, except for the locations at the ends of the sample rows and at the top of the cooler. The temperature at the top of the cooler, near the lid where warmer air can enter the cooler, would be expected to be higher than the temperature in the center of the cooler. The temperature data for the locations at the ends of the sample rows, which are next to the cooler walls, show that a modification to the cooler design is needed to decrease the temperature along the cooler wall. To address this, four half bags of PCM containing 150 grams of formulation were prepared for placement at each end of the two sample rows. The results of the experiment using the half bags in the cooler design are discussed below.

5. Cooler Experiment Involving Double Layer Insulation, Thin Sheets of Frozen PCM Lining the Cooler Walls, and PCM Half Bags The cooler used in this experiment had the same design as the cooler used in the previous experiment, except half bags of frozen PCM were placed at the ends of the sample rows for extra freezing potential, and instead of placing a temperature data logger at the top of the cooler, an extra temperature data logger was placed in the top row of samples. In addition, the bubble wrap had to be removed from the VOA vials when the cooler was being packed because there was not enough room in the cooler for the wrapped vials and half bags.

The cooler in this experiment was stored for 72 hours. The temperature in the room where the cooler was stored ranged from 22.7 to 25.3° C. over the 72-hour period, with a mean temperature of 24.0° C. Temperature data recorded by the 10 data loggers in the cooler are listed in Table 4.

As shown in Table 4, the temperature data recorded during sample storage are excellent. The locations where the ten temperature data loggers were placed in the cooler all had temperatures at <−7° C. for at least 52 hours, and in most cases much longer. As shown in Table 4, the temperatures at the ends of the sample rows were at <−7° C. for 11 to 14 hours longer in this cooler as compared to temperatures in the cooler with no PCM half bags. For field work, samples in VOA vials being shipped in a cooler must be wrapped in protective material to prevent breakage. As a result, the following experiment was performed using smaller sheets of bubble wrap around the VOA vials.

6. Cooler Experiment Involving Double Layer Insulation, Thin Sheets of Frozen PCM Lining the Cooler Walls, PCM Half Bags, and Sample Vials in Bubble Wrap The cooler in this experiment was stored for 76 hours. After one hour of storage, the average cooler temperature was −20.2° C. Temperatures in the cooler after extended storage are listed in Table 5. As shown in Table 5, the temperatures ranged from −7.6° C. to −7.1° C. after 55 to 70 hours of storage depending on the location of the temperature data logger. The temperatures maintained by this cooler design meet the EPA temperature criteria for frozen preservation during sample storage/shipping. As previously mentioned, the range of frozen temperature storage recommended by EPA for environmental samples is <−7 to −20° C. In addition, the temperature in the room where the cooler was stored while the temperature data were generated ranged from 20.7° C. to 31.1° C. during the storage period. This is a temperature range that could easily be expected for use of the system in the field. FIG. 1 shows a diagram of the cooler configuration used in this experiment and the storage times for which the temperatures at the various cooler locations were less than −7.0° C.

The cooler design for the integrated freezer system has been optimized so that storage time at <−7 to −20° C. within the system has been increased to much more than 48 hours. The temperatures maintained by the current integrated freezer system design shown in FIG. 1 meet the EPA temperature criteria for frozen preservation during storage/shipping.

Using freezing as a preservation technique, in certain embodiments, sample holding time can be extended from 48 hours to 14 days. Samples shipped using the integrated freezer system would not need to be received by a laboratory within 48 hours, thereby reducing shipping costs. In addition, once samples are received by a laboratory, they could easily be transferred to a freezer for additional storage prior to being prepared for analysis, which would reduce analytical costs. These cost reductions will significantly benefit environmental remediation activities.

Temperature data from these experiments show that the average cooler temperature after one hour of storage was approximately −20° C. and that temperatures ranged from −7.6° C. to −7.1° C. after 55 to 70 hours of storage depending on the location of the temperature data logger in the cooler. Incidentally, it is of note that although method claims are the claims initially presented in this application, the inventive technology also contemplates apparatus that correlate with the method claims, or that are otherwise supported by this application.

As can be easily understood from the foregoing, the basic concepts of the present invention may be embodied in a variety of ways. It involves both cooling techniques as well as devices to accomplish the appropriate cooling. In this application, the cooling techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "cooler" should be understood to encompass disclosure of the act of "cooling"—whether explicitly discussed or not—and, conversely, were there effectively disclosure of the act of "cooling", such a disclosure should be understood to encompass disclosure of a "cooler" and even a "means for cooling" Such changes and alternative terms are to be understood to be explicitly included in the description.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the cooling devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim v. Cannon Avent Group, PLC*, 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

TABLE 1

Temperature Data Recorded by the Four Temperature Data Loggers in the Cooler having Single Layer Insulation

| Location in Cooler | Storage Time | Temperature |
|---|---|---|
| Left end of bottom sample row | 31 hours | −7.1° C. |
| | 32 hours | −6.9° C. |
| Middle of bottom sample row | 50 hours (cooler opened) | −14.3° C. |

TABLE 1-continued

Temperature Data Recorded by the Four Temperature Data Loggers in the Cooler having Single Layer Insulation

| Location in Cooler | Storage Time | Temperature |
|---|---|---|
| Right end of top sample row: | 37 hours | −7.4° C. |
| | 38 hours | −6.9° C. |
| Middle of top sample row: | 50 hours (cooler opened) | −10.8° C. |

TABLE 2

Temperature Data Recorded by the Four Temperature Data Loggers in the Cooler having Double Layer Insulation

| Location in Cooler | Storage Time | Temperature |
|---|---|---|
| Left end of bottom sample row | 46 hours | −7.4° C. |
| | 47 hours | −6.9° C. |
| Middle of bottom sample row: | 50 hours (cooler opened) | −11.3° C. |
| Right end of top sample row | 34 hours | −7.3° C. |
| | 35 hours | −6.9° C. |
| Middle of top sample row | 50 hours (cooler opened) | −8.5° C. |

TABLE 3

Temperature Data Recorded by the Ten Temperature Data Loggers in the Cooler having Double Layer Insulation and Thin Sheets of Frozen PCM Lining the Cooler Walls

| Location in Cooler | Storage Time | Temperature |
|---|---|---|
| Bottom of cooler | 49 hours | −7.5° C. |
| | 50 hours | −7.0° C. |
| Left end of bottom sample row | 43 hours | −7.6° C. |
| | 44 hours | −7.0° C. |
| Middle of bottom sample row | 51 hours (cooler opened) | −10.7° C. |
| Between the fifth and sixth samples in bottom row | 51 hours (cooler opened) | −14.8° C. |
| Right end of bottom sample row | 47 hours | −7.4° C. |
| | 48 hours | −6.9° C. |
| Left end of top sample row | 45 hours | −7.4° C. |
| | 46 hours | −6.9° C. |
| Between the first and second sample in top row | 49 hours | −7.4° C. |
| | 50 hours | −6.9° C. |
| Middle of top sample row | 51 hours (cooler opened) | −9.6° C. |
| Right end of top sample row | 40 hours | −7.5° C. |
| | 41 hours | −7.0° C. |
| Top of cooler | 21 hours | −7.3° C. |
| | 22 hours | −6.9° C. |
| | 51 hours (cooler opened) | 3.6° C. |

TABLE 4

Temperature Data Recorded by the Ten Temperature Data Loggers in the Cooler having Double Layer Insulation, Thin Sheets of Frozen PCM Lining the Cooler Walls, and PCM Half Bags

| Location in Cooler | Storage Time | Temperature |
|---|---|---|
| Bottom of cooler | 53 hours | −7.2° C. |
| | 54 hours | −6.8° C. |
| Left end of bottom sample row | 57 hours | −7.2° C. |
| | 58 hours | −6.6° C. |
| Middle of bottom sample row | 63 hours | −7.6° C. |
| | 64 hours | −6.9° C. |
| Between the fifth and sixth samples in bottom row | 65 hours | −7.1° C. |
| | 66 hours | −6.9° C. |
| Right end of bottom sample row | 58 hours | −7.5° C. |
| | 59 hours | −6.9° C. |
| Left end of top sample row | 57 hours | −7.3° C. |
| | 58 hours | −6.7° C. |
| Between the first and second sample in top row | 54 hours | −7.1° C. |
| | 55 hours | −6.8° C. |

TABLE 4-continued

Temperature Data Recorded by the Ten Temperature Data Loggers in the Cooler having Double Layer Insulation, Thin Sheets of Frozen PCM Lining the Cooler Walls, and PCM Half Bags

| Location in Cooler | Storage Time | Temperature |
|---|---|---|
| Middle of top sample row | 63 hours | −7.4° C. |
| | 64 hours | −6.7° C. |
| Between the fifth and sixth | 64 hours | −7.1° C. |
| samples in top row | 65 hours | −6.3° C. |
| Right end of top sample row | 52 hours | −7.6° C. |
| | 53 hours | −7.0° C. |

TABLE 5

Temperature Data Recorded by the Nine Temperature Data Loggers in the Cooler having Double Layer Insulation, Thin Sheets of Frozen PCM Lining the Cooler Walls, PCM Half Bags, and Sample Vials in Bubble Wrap

| Location in Cooler | Storage Time | Temperature |
|---|---|---|
| Bottom of cooler | 56 hours | −7.1° C. |
| | 57 hours | −6.8° C. |
| Left end of bottom sample row | 64 hours | −7.5° C. |
| | 65 hours | −6.8° C. |
| Between the first and second | 70 hours | −7.1° C. |
| samples in bottom row | 71 hours | −6.3° C. |
| Middle of bottom sample row | 65 hours | −7.4° C. |
| | 66 hours | −6.8° C. |
| Right end of bottom sample row | 60 hours | −7.3° C. |
| | 61 hours | −6.7° C. |
| Left end of top sample row | 60 hours | −7.6° C. |
| | 61 hours | −7.0° C. |
| Middle of top sample row | 65 hours | −7.3° C. |
| | 66 hours | −6.7° C. |
| Between the fifth and sixth | 62 hours | −7.3° C. |
| samples in top row | 63 hours | −6.6° C. |
| Right end of top sample row | 55 hours | −7.1° C. |
| | 56 hours | −6.5° C. |

What is claimed is:

1. An improved method for maintaining temperature sensitive material at sub-ambient temperatures comprising the steps of:

determining a need to maintain said temperature sensitive material at from −7° C. to −20° C. for at least 47 hours;

obtaining a closeable, insulated container that is able to contain said temperature sensitive material therein;

wherein said closeable, insulated container has an airtight lid and, when closed, has an inner container surface, defines an interior center, and forms an airtight vapor barrier, selecting a sodium chloride and water solution phase change material (PCM) appropriate for said 47 hour time period and said temperature range;

cooling said PCM so that a starting temperature of said PCM material immediately before closure of said closeable, insulated container for shipment thereof is lower than a melting temperature of said PCM material, establishing a layered, insulated PCM assemblage inside of said inner container surface and to fully surround said temperature sensitive material, and maintaining said temperature sensitive material at from said −7° C. to −20° C. for said at least 47 hours;

wherein said layered, insulated PCM assemblage itself comprises:

double layered, foil-foam-foil insulating foam material enclosed PCM sections established between said insulating foam material and said interior center, said enclosed PCM sections established so as to fully surround said temperature sensitive material, additional enclosed PCM sections established between said insulating foam material and said inner container surface, wherein said additional enclosed PCM sections comprise enclosed PCM sheets, wherein said step of establishing a layered, insulated PCM assemblage inside of said inner container surface and to fully surround said temperature sensitive material comprises the step of closing said airtight lid, and wherein said method does not comprise using dry ice in any manner.

2. An improved method as described in claim 1 further comprising the step of filling at least a portion of unoccupied space with non-PCM before closing said airtight lid.

3. An improved method as described in claim 2 wherein said non-PCM comprises space-filler insulation.

4. An improved method as described in claim 3 wherein said space-filler insulation comprises insulation selected from the group consisting of foam and bubble wrap.

5. An improved method as described in claim 1 further comprising the step of adding PCM packets internally of said enclosed PCM sections when at least a majority of said sections are established inside of said closeable, insulated container.

6. An improved method as described in claim 1 wherein at least one of said PCM sections is a lid-affiliated PCM section.

7. An improved method as described in claim 6 wherein said lid-affiliated PCM section is incorporated as part of said airtight lid.

8. An improved method as described in claim 1 wherein said inner container surface comprises inner side wall surfaces, an inner upper lid surface, and an inner bottom floor surface.

9. An improved method as described in claim 1 wherein said airtight lid comprises a flexible gasket, airtight lid.

10. An improved method as described in claim 1 wherein foil of said foil-foam-foil insulating foam material comprises a foil selected from the group consisting of mylar and metal foil.

11. An improved method as described in claim 1 wherein said temperature sensitive material comprises material selected from the group consisting of non-frozen food, frozen food, drink, flowers, plants, blood, serum, plasma, serum, pharmaceuticals, frozen hockey pucks, non-frozen environmental samples and frozen environmental samples.

12. An improved method as described in claim 1 wherein said step of obtaining a closeable, insulated container comprises the step of manufacturing a closeable, insulated container.

13. An improved method as described in claim 1 wherein said step of obtaining a closeable, insulated container comprises the step of obtaining a commercially available closeable, insulated container.

14. An improved method as described in claim 1 wherein said insulating foam material is modular.

15. An improved method as described in claim 1 wherein said enclosed PCM sections are modular.

16. An improved method as described in claim 1 wherein said layered PCM assemblage is manually removable from said closeable, insulated container.

17. An improved apparatus as described in claim 1 wherein said enclosed PCM sheets are established within said closeable, insulated container.

18. An improved method as described in claim 1 wherein said sodium chloride and water solution phase change material is substantially 17 wt % NaCl and 83 wt % deionized, distilled water.

19. An improved method as described in claim 1 wherein said enclosed PCM sheets are attached to at least a portion of said inner container surface.

20. An improved apparatus as described in claim 19 wherein said enclosed PCM sheets are attached to at least a portion of said inner container surface.

21. An improved method as described in claim 1 wherein said temperature sensitive material comprises samples arranged in at least two rows and wherein at least some of said enclosed PCM sections established between said insulating foam material and said interior center are established between said rows of said samples of said temperature sensitive material.

22. An improved apparatus for maintaining temperature sensitive material at from −7° C. to −20° C. for at least 47 hours, said apparatus comprising a closeable, insulated container able to contain said temperature sensitive material therein;

wherein said closeable, insulated container has an airtight lid and, when closed, has an inner container surface, defines an interior center, and forms an airtight vapor barrier, a layered, insulated phase change material (PCM) assemblage inside of said inner container surface and fully surrounding said temperature sensitive material, wherein said layered, insulated PCM assemblage itself comprises:

doubled layered, foil-foam-foil insulating foam material enclosed PCM sections established between said insulating foam material and said interior center, said enclosed PCM sections fully surrounding said interior center, and wherein phase change material of said enclosed PCT sections is a sodium chloride and water solution and is associated with said time period and at least one of said maximum temperature and said temperature range, wherein a starting temperature of said PCM material immediately before closure of said closeable, insulated container for shipment thereof is lower than a melting temperature of said PCM material, and wherein said apparatus does not comprise dry ice.

23. An improved apparatus as described in claim 22 further comprising non-PCM established to fill unoccupied space within said closeable, insulated container.

24. An improved apparatus as described in claim 22 wherein said non-PCM comprises space-filler insulation.

25. An improved apparatus as described in claim 22 further comprising PCM packets established internally of said layered, insulated PCM assemblage.

26. An improved apparatus as described in claim 22 wherein at least one of said PCM sections is a lid-affiliated PCM section.

27. An improved apparatus as described in claim 26 wherein said lid-affiliated PCM section is incorporated as part of said airtight lid.

28. An improved apparatus as described in claim 22 wherein said temperature sensitive material comprises material selected from the group consisting of non-frozen food, frozen food, drink, flowers, plants, blood, serum, plasma, serum, pharmaceuticals, frozen hockey pucks, non-frozen environmental samples and frozen environmental samples.

29. An improved apparatus as described in claim 22 wherein said closeable, insulated container is a commercially available closeable, insulated container.

30. An improved apparatus as described in claim 22 wherein said insulating foam material is modular.

31. An improved apparatus as described in claim 22 wherein said enclosed PCM sections are modular.

32. An improved apparatus as described in claim 22 wherein said layered PCM assemblage is manually removable from said closeable, insulated container.

33. An improved apparatus as described in claim 22 wherein said layered, insulated PCM assemblage further comprises additional enclosed PCM sections established between said insulating foam material and proximally said inner container surface, wherein said additional enclosed PCM sections comprise enclosed PCM sheets.

34. An improved apparatus as described in claim 33 wherein said enclosed PCM sheets are established within said closeable, insulated container.

35. An improved apparatus as described in claim 22 wherein said sodium chloride and water solution PCM is substantially 17 wt % NaCl and 83 wt % deionized, distilled water.

36. An improved apparatus as described in claim 22 wherein said layered, insulated PCM assemblage comprises additional enclosed PCM sections established between said insulating foam material and said inner container surface, wherein said additional enclosed PCM sections comprise enclosed PCM sheets.

37. An improved apparatus as described in claim 22 wherein said temperature sensitive material comprises samples arranged in at least two rows and wherein at least some of said enclosed PCM sections established between said insulating foam material and said interior center are established between said rows of said samples of said temperature sensitive material.

* * * * *